US008878735B2

(12) United States Patent
Kvist et al.

(10) Patent No.: US 8,878,735 B2
(45) Date of Patent: Nov. 4, 2014

(54) ANTENNA SYSTEM FOR A WEARABLE COMPUTING DEVICE

(71) Applicants: Soren Kvist, Vaerlose (DK); Jesper Thaysen, Skovlunde (DK)

(72) Inventors: Soren Kvist, Vaerlose (DK); Jesper Thaysen, Skovlunde (DK)

(73) Assignee: GN Resound A/S, Ballerup (DK)

( * ) Notice: Subject to any disclaimer, the term of this patent is extended or adjusted under 35 U.S.C. 154(b) by 0 days.

(21) Appl. No.: 13/896,220

(22) Filed: May 16, 2013

(65) Prior Publication Data

US 2013/0342407 A1 Dec. 26, 2013

(30) Foreign Application Priority Data

Jun. 25, 2012 (DK) ..... 2012 70361

(51) Int. Cl.

| | |
|---|---|
| ***H01Q 1/12*** | (2006.01) |
| ***H01Q 1/27*** | (2006.01) |
| ***H01Q 13/10*** | (2006.01) |
| ***H04R 25/00*** | (2006.01) |

(52) U.S. Cl.

CPC ..... *H01Q 1/273* (2013.01); *H01Q 13/10* (2013.01); *H04R 25/554* (2013.01)

USPC ..... 343/718; 343/702; 343/767

(58) Field of Classification Search

USPC ..... 343/702, 718, 767, 769; 381/323

See application file for complete search history.

(56) References Cited

U.S. PATENT DOCUMENTS

| | | | | |
|---|---|---|---|---|
| 5,539,420 | A | 7/1996 | Dusseux et al. | |
| 6,028,561 | A | 2/2000 | Takei | |
| 2010/0156728 | A1* | 6/2010 | Alvey et al. | 343/702 |
| 2011/0280224 | A1* | 11/2011 | Falck et al. | 370/336 |
| 2012/0087506 | A1 | 4/2012 | Ozden | |
| 2012/0093324 | A1 | 4/2012 | Sinasi | |

FOREIGN PATENT DOCUMENTS

| | | | |
|---|---|---|---|
| EP | 2 065 976 | A1 | 6/2009 |
| JP | 2005-079974 | A | 3/2005 |
| JP | 2012-049865 | | 3/2012 |
| WO | 2005/081583 | A1 | 9/2005 |
| WO | 2005/123186 | A1 | 12/2005 |
| WO | 2011/116463 | A1 | 9/2011 |
| WO | 2012/059302 | A2 | 5/2012 |

OTHER PUBLICATIONS

1st Technical Examination and Search Report dated Feb. 8, 2013, for DK Patent Application No. PA 2012 70361, 4 pages.

2nd Technical Examination—Intention to Grant dated Jul. 10, 2013, for DK Patent Application No. PA 2012 70361, 2 pages.

1st Japanese Office Action dated Sep. 17, 2013 for JP Patent Application No. 2013-126835, 4 pages.

Extended European Search Report dated Oct. 14, 2013 for corresponding EP Patent Application No. EP 13173622.5, 8 pages.

* cited by examiner

*Primary Examiner* — Tan Ho

(74) *Attorney, Agent, or Firm* — Vista IP Law Group, LLP

(57) ABSTRACT

An antenna system includes: an antenna; and a transceiver for wireless data communication interconnected with the antenna for electromagnetic field emission and electromagnetic field reception; wherein the antenna comprises: an electrically conductive material, and a slot in the electrically conductive material, the slot extending in a plane that is substantially parallel with a body of a user when the antenna system is worn in its operational position by the user, the slot being configured to cause emission of an electromagnetic field upon excitation.

13 Claims, 16 Drawing Sheets

ANTENNA SYSTEM FOR A WEARABLE COMPUTING DEVICE

RELATED APPLICATION DATA

This application claims priority to and the benefit of Danish Patent Application No. PA 2012 70361, filed on Jun. 25, 2012. The entire disclosure of the above application is expressly incorporated by reference herein.

FIELD

The present disclosure relates to the field of antennas, especially to antennas to be used at or in close proximity to a user body, such as antennas for providing wireless communication.

BACKGROUND

More and more electronic devices are used as provided on, in or in close proximity to a user and a user body. Typically, communication between these electronic devices or communication from these devices to devices provided externally from the user are provided for example using body area networks, wireless body area networks or wearable body area networks. The body area network field is being developed to for example allow inexpensive and continuous health monitoring. The monitoring may include real-time updates of medical records via the internet, and it may allow for early detection of medical conditions for example by implanting bio-sensors inside the human body to collect various physiological changes in order to monitor a patient's health status. Also other electronic devices provided at, in or in close proximity to a user, such as hearing aids provided in or behind the ear of a hearing impaired person, may communicate with externally provided electronic devices, such as hearing aid accessories. The body area networks are typically implemented using wireless standards, such as for example Bluetooth. However, use of the Bluetooth standard for communication requires a significant power source, typically not available in small biosensors, hearing aids, etc.

Furthermore, personal area networks providing exchange of digital information by capacitively coupling picoamp currents through the body for communication between electronic devices provided on or near the human body have been suggested.

Typically, however, significant losses are experienced during transfer of signals from an electronic device provided at or in close proximity to a user due to absorption of electromagnetic radiation by the human body. This may be overcome by increasing the power of the signals, however, this leads to an increased power consumption which is typically not desirable. Furthermore, for small electronic devices, such as wearable electronic devices, positioned at or in close proximity to the user, power sources are limited and an increased power consumption for transmitting wireless signals is not a viable solution.

SUMMARY

It is an object to overcome at least some of the disadvantages as mentioned above, and it is a further object to provide an antenna device specifically for being operated in close proximity to a user body.

In one aspect, the above-mentioned and other objects are obtained by providing a hearing aid comprising a transceiver for wireless data communication interconnected with an antenna for emission and reception of an electromagnetic field. The hearing aid may further comprise a microphone for reception of sound and conversion of the received sound into a corresponding first audio signal and a signal processor for processing the first audio signal into a second audio signal compensating a hearing loss of a user of the hearing aid. A receiver may be connected to an output of the signal processor for converting the second audio signal into an output sound signal. The antenna, such as an electric antenna, may comprise an electrically conductive material and a slot provided in the electrically conductive material. The slot may extend in a plane being substantially orthogonal with an ear to ear axis of the user when the hearing aid is worn in its operational position by a user. The slot may be configured to cause emission of an electromagnetic field upon excitation. Hereby, an electromagnetic field emitted by the antenna may propagate along the surface of the head of the user with its electrical field substantially orthogonal to the surface of the head of the user. The antenna may be a slot antenna, such as a planar slot antenna.

The slot antenna is thus provided parallel to, or substantially parallel to, the surface of the head. It is an advantage of using a slot antenna that the electric field emitted from the slot antenna is orthogonal to the surface of the head when the slot extends in a plane being substantially orthogonal with an ear to ear axis.

In another aspect, an antenna system for a wireless body area network, such as a body sensor network, is provided. The antenna system comprises a transceiver for wireless data communication interconnected with an antenna for emission and reception of an electromagnetic field. The antenna may comprise an electrically conductive material and a slot provided in the electrically conductive material. The slot may extend in a plane being substantially parallel with a user body when the antenna system is worn in its operational position by a user, the slot being configured to cause emission of an electromagnetic field upon excitation. The electromagnetic field emitted by the antenna may propagate along the surface of the user with its electrical field substantially orthogonal to the surface of the user.

In that the slot antenna is provided parallel to, or substantially parallel to, the surface of a body the electric field emitted from the slot antenna may be orthogonal to the surface of the body. Typically, the antenna system is provided in a wearable computing device.

The antenna system may be provided on or parallel to a face plate of an in-the-ear hearing aid, the antenna system may be provided on or parallel to a side plate of a behind-the-ear hearing aid, the antenna system may be provided on a substrate of a wearable computing device, such as of a medical device, the substrate being configured to be positioned parallel to a body of a user.

In a further aspect, an in-the-ear hearing aid is provided. The in-the-ear hearing aid may comprise a microphone for reception of sound and conversion of the received sound into a corresponding first audio signal, a signal processor for processing the first audio signal into a second audio signal compensating a hearing loss of a user of the hearing aid and a receiver that is connected to an output of the signal processor for converting the second audio signal into an output sound signal to be provided to the user. The in-the-ear hearing aid may further comprise a face plate, a transceiver for wireless data communication interconnected with an antenna for emission and reception of an electromagnetic field. The antenna, such as an electric antenna, may comprise an electrically conductive material and a slot provided in the electrically conductive material. The slot may extend in a plane being substantially orthogonal with an ear to ear axis of the user when the hearing aid is worn in its operational position by a user. The slot may be configured to cause emission of an electromagnetic field upon excitation. Hereby, an electromagnetic field emitted by the antenna may propagate along the surface of the head of the user with its electrical field substantially orthogonal to the surface of the head of the user. The antenna may be a slot antenna, such as a planar slot antenna. Upon excitation the antenna may emit an electromagnetic field.

It is an advantage of positioning the slot antenna on the face plate in that the antenna, thus, is provided in plane with the surface of the head, or substantially in plane with the surface of the head. Hereby, the emitted electromagnetic field is less prone to losses due to surrounding tissue. The face plate may form part of an outer shell of the hearing aid.

Upon excitation, a substantial part of the electromagnetic field, such as 60%, such as 80%, emitted by the antenna may propagate along the surface of the body or the head of the user with its electrical field substantially orthogonal to the surface of the body or the head of the user. When the electromagnetic field is diffracted around the body or the head of a user, loses due to the interaction with the surface of the body or the head may be minimized. Hereby, a significantly improved reception of the electromagnetic radiation by a second wearable computing device or a second hearing aid in a binaural hearing aid system, typically located at the other ear of a user, or by a hearing aid accessory, such as a remote control, a telephone, a television set, a spouse microphone, a hearing aid fitting system, an intermediary component, such as a Bluetooth bridging device, etc., is obtained.

Thus, an antenna system according to some embodiments may be configured to enable communication between at least two wearable computing devices.

The direction substantially orthogonal to a surface of the user body typically refers to a direction being substantially orthogonal to the surface of the user body in an area immediately surrounding the antenna device, when the antenna device is provided in an intended operational position at or in close proximity to the user. It is envisaged that in the present disclosure, the term user body encompasses the entire body including limbs, torso and head.

The antenna device may be provided at or in close proximity to the user in any way suitable for the use of the antenna device, and the antenna device may thus be configured to be carried by a user and the antenna device may be incorporated in a wearable electronic device, or it may be provided in connection with the wearable electronic device. The antenna device may also be provided as a "clip on" device, it may be configured to be carried in an armband, or a band for positioning around any other suitable body part. The antenna device may be provided on a user body using adhesive or being incorporated into the body using surgery. The antenna device may furthermore be provided in a necklace, a bracelet, a wrist watch, a pin or the like, or as a pendant to a necklace or a bracelet.

It is an advantage of providing such an antenna device that interconnection either in-between an electronic device provided at or in close proximity to a user, such as body sensors, such as for example continuous glucose sensors, medical devices, such as cardiac devices, etc., or wearable electronic devices, such as for example hearing aids, such as body area networks, such as for example a Body Area Network, BAN, or a wireless body area network, or WBAN, such as a wearable wireless body area network, or between an electronic device as mentioned above and provided at or in close proximity to a user and a body external transceiver or body external electronic device may be obtained. The body external transceiver or body external electronic device may be a processing unit and may be configured to be process the received signals providing an output for a user, or it may be connected to an operator, an alarm service, a health care provider, a doctors network, etc., either via the internet or any other intra- or interconnection between a number of computers or processing units, either continuously or upon request from either a user, an operator, a provider, or a system generated trigger. It is a further advantage that the antenna device may provide interconnection between one or more electronic devices provided at or in close proximity to the user body. The antenna device may connect to external electronic devices either directly, by providing an additional antenna in the antenna device, or via an intermediate antenna device.

The antenna device may be provided separately, or the antenna device may form part of an electronic device configured to operate in, at or in close proximity to a user. Preferably, the antenna structure comprises a resonant antenna structure.

In one or more embodiments, the electromagnetic field is diffracted around the head of a user with minimum interaction with the surface of the head, the strength of the electromagnetic field around the head of the user is significantly improved. Thus, the interaction with other antennas and/or transceivers, as provided in either a second hearing aid of a binaural hearing aid system located at the other ear of a user, or as provided in accessories as mentioned above, which typically are located in front of a user, is enhanced. It is a further advantage of providing an electromagnetic field around the head of a user that an omni-directional connectivity to external devices, such as accessories, is provided.

The antenna may, thus, during use emit a substantially TM polarized electromagnetic field for diffraction along the users body, such as around the head of a user, i.e. the emitted electromagnetic field is TM polarized with respect to the surface of the body of a user, such as with respect to the surface of the head of a user.

It is a further advantage of using a slot antenna that when applying energy to the slot antenna, i.e. exciting or feeding the slot, current flows in the electrically conductive material without being confined to the edges of the slot and a higher power of the radiated field may be achieved than when using a standard antenna, such as for example a standard monopole antenna.

The conductive material may be a support substrate, such as a print, such as a flexible print, and the slot may be a slot cut into the support element, such as cut into the print. The conductive material may also be a conductive material provided onto a non-conductive support element, and the conductive material may form a conductive layer of conductive material on the support element. The slot may be provided as a removal of the conductive material, i.e. as a slot in the conductive layer. The slot may be void of conductive material. Typically, the conductive material will form a ground plane for the slot antenna.

The antenna does not, or substantially does not, emit an electromagnetic field in the direction of the ear to ear axis of the user during use when the hearing aid housing is positioned in its operational position at the ear of the user; rather, the antenna is configured to emit a tailored electromagnetic field that propagates mainly in a direction parallel to the surface of the head of the user when the hearing aid housing is positioned in its operational position during use, whereby the electric field of the emitted electromagnetic field has a direction that is orthogonal to, or substantially orthogonal to, the surface of the head at least along the side of the head at which the antenna is positioned during operation. In this way, propagation loss in the tissue of the head is reduced as compared to propagation loss of an electromagnetic field with an electric field component that is parallel to the surface of the head. Diffraction around the head makes the electromagnetic field emitted by the connecting antenna propagate from one ear and around the head to the opposite ear.

The antenna may be excited using any conventional means, using a direct or an indirect or coupled feed, and for example be fed using a feed line for exciting an electromagnetic field in the slot. In one or more embodiments, the antenna is fed using a strip line or a microstrip line which is provided below the slot along the back side of the antenna or the back side of a support element for the antenna. The electrical radiation may thereby, especially for high frequencies, couple from the strip line to the slot, even with no direct connection. The strip line may be a transmission line, and be a linear feed line, a T-line, etc. Typically, the strip line extends across a width of the slot. It is envisaged that also a point feed, or any other feed may be used.

The antenna may be a resonant antenna, thus, the slot may form a resonant structure. The current flowing in a resonant antenna forms standing waves along the length of the antenna, in this case particularly along the length of the slot. The resonant antenna is typically operated at, or approximately at, a resonance frequency at which the length of the slot equals half a wavelength or any multiple thereof, or a quarter wavelength or any odd multiple thereof, of the emitted electromagnetic field. Thereby, in one or more embodiments, the slot may have a length of ½ wavelength or any multiple thereof or ¼ wavelength or any odd multiple thereof.

The slot may have any form suitable for emission of an electromagnetic field.

In one or more embodiments the slot has the form an elongated antenna, a rod or monopole antenna. Using an elongated antenna as a slot-dipole, the impedance of the slot may be tailored by adjusting the distance between the feed and the an end point of the elongated antenna. The antenna may be a straight line, a twisted line, a coiled line, a fractal formed antenna, etc. Typically, if the slot extends to the edge of the conductive material, the antenna characteristics will become the dual of a monopole antenna, and the optimal length may be ¼ wavelength.

Alternatively, the slot may have the form of a loop, and in one or more embodiments, the slot forms a single loop. The slot loop may be folded, twisted or fractal formed to thereby achieve a greater length in a smaller space. The resonant slot loop may be ½ wavelength to maximize the bandwidth of the antenna, however also slot loops having a shorter length, such as ¼ wavelength, or less than ¼ wavelength may be used.

Especially for hearing aids, the space constraints are significant. In one or more embodiments, the electrically conductive material may provided on or parallel to, such as substantially parallel to, a face plate of an in-the-ear hearing aid. Thus, the slot is provided in a material on or parallel to the face plate.

In one or more embodiments, the electrically conductive material may be provided on or parallel to a side plate of a behind-the-ear hearing aid, preferably on the side plate facing away from the user, i.e. the side plate opposite the users head.

The slot may have a surface area that is less than a surface area of the electrically conductive material. For example, the overall length of the slot relative to a circumference of the face plate may be less than a threshold value, such as less than one, such as less than a threshold value of one.

The conductive material may form a ground plane for the slot antenna, alternatively, a ground plane for the antenna may be provided on a back side of the electrically conductive material, such as on a back side of a supporting substrate on top of which the conductive material is provided. The width of the slot may be tailored according to an antenna impedance, and the antenna impedance may be adjusted by adjusting the width of the slot. By increasing the width of the slot, the impedance may increase. Furthermore, the efficiency of the antenna may decrease if the slot is too thin, in that a significant electric field will build in the slot, thus increasing losses. In one or more embodiments, the slot has a width of between 1/200 wavelength and 1/25 wavelength. The width of the slot may be below 2 mm, such a below 1 mm, such as below 0.5 mm.

Furthermore, a reflector plane for the antenna may be provided. The reflector plane may be provided below the conductive layer, such as below a supporting substrate on which the conductive material is provided as a top layer, such as closer to the centre of the body. For an in-the-ear hearing aid, typically, the antenna will be provided in an outer part of the hearing aid, typically on a face plate of the in-the-ear hearing aid. The feed line is typically provided right below the face plate, that is towards the ear drum with respect to the face plate. The reflector plane may be provided below the face plate, in embodiments in which a feed line is present, also below the plane comprising the feed line. Thus, the reflector plane is typically provided below or behind the face plate, closer to the body or closer to the ear drum when the hearing aid is positioned in its operative position in the ear of a user. The hearing aid may thus have an electrically conductive material provided on a first layer, a feed line may be provided in a second layer, the second layer being parallel to, or substantially parallel to the first layer and the second layer may be positioned closer to an ear drum of a user than the first layer when the hearing aid is worn in its operational position by a user. A third layer may be configured to form a reflector plane for the antenna.

An opening may be provided in the electrically conductive material, the opening being configured to receive a hearing aid battery. The opening may be provided in the electrically conductive material and any supporting elements or supporting substrates. The opening may be provided in the first layer and/or the third layer for receiving a hearing aid battery. In one or more embodiments, the slot may form a loop, and the opening may be provided in the electrically conductive material within the loop. Thus, the slot may form a loop formed slot provided in the electrically conductive surface, and the opening may be provided within the loop formed slot. In one or more embodiments, the opening is provided at a distance from the slot, so as to reduce the influence of the opening on the electric provided in the slot.

Typically, a door is provided to close the opening into the battery and the hearing aid interior. In one or more embodiments, the door may have an electrically conductive surface, the door being configured to close the battery opening.

In one or more embodiments, a gap may be formed between the door and the electrically conductive material. The gap may be configured to form the loop formed slot. Hereby, the distance between the door and the electrically conductive material provided for example on a substrate, may form the slot. The gap may be a slot extending along the circumference of the door, such as along one or more sides of the door, such as a loop slot encompassing the opening, or the gap between the door and the electrically conductive material may form part of the slot, such as part of a loop slot Furthermore, a capacitor may be provided, the capacitor being configured to be positioned across the slot for tuning the center frequency of the antenna. In one or more embodiments, the capacitor is positioned on the opposite side of the feed entry points.

The hearing aid may comprise a housing and the antenna comprising the electrically conductive material and the slot may be accommodated within the hearing aid housing, preferably so that the antenna is positioned inside the hearing aid housing without protruding out of the housing.

It is an advantage that, during operation, the slot antenna contributes to an electromagnetic field that travels around the head of the user thereby providing a wireless data communication that is robust and has low loss.

Due to the current component normal to the side of the head or normal to any other body part, the surface wave of the electromagnetic field may be more efficiently excited. Hereby, for example an ear-to-ear path gain may be improved, such as by 10-15 dB, such as by 10-20 dB.

The slot antenna may emit a substantially TM polarized electromagnetic field for diffraction around the head of a user, i.e. TM polarised with respect to the surface of the head of a user.

The slot antenna does not, or substantially does not, emit an electromagnetic field in the direction of the ear to ear axis of the user when the hearing aid housing is positioned in its operational position at the ear of the user; rather, the antenna emits an electromagnetic field that propagates in a direction parallel to the surface of the head of the user when the hearing aid housing is positioned in its operational position during use, whereby the electric field of the emitted electromagnetic field has a direction that is orthogonal to, or substantially orthogonal to, the surface of the head at least along the side of the head at which the antenna is positioned during operation. In this way, propagation loss in the tissue of the head is reduced as compared to propagation loss of an electromagnetic field with an electric field component that is parallel to the surface of the head. Diffraction around the head makes the electromagnetic field emitted by the antenna propagate from one ear and around the head to the opposite ear.

The hearing aid antenna comprising the parasitic antenna element, the first section and the primary antenna element may be configured for operation in the ISM frequency band. The antenna device may be configured to be operated at any frequency. Preferably, the antenna device is configured for operation at a frequency of at least 1 GHz, such as at a frequency between 1.5 GHz and 3 GHz such as at a frequency of 2.4 GHz.

In a further aspect, a hearing aid system may be provided, the hearing aid system comprising a hearing aid and an antenna system according to any of the above described antenna systems.

The hearing aid system may further comprise one or more hearing aid accessories, wherein at least one of the hearing aid accessories comprises an accessory antenna device according to any of the above described antenna devices. The at least one hearing aid accessory may be configured to be provided at or in close proximity to a user body and configured to communicate with the hearing aid antenna device. The at least one hearing aid accessory may for example be a remote control, and the remote control and the accessory antenna device may be provided in the form of a wearable electronic device, such as for example in the form of a wrist watch, or wrist band.

The wearable electronic device may further comprise an external antenna configured to communicate with one or more external electronic devices, such as other hearing aid accessories, hearing aid configuration software, testing software, etc.

In one embodiment of the hearing aid system, communication between the one or more external electronic devices, such as hearing aid accessories, and the hearing aid, may be performed via the wearable electronic device.

An antenna system includes: an antenna; and a transceiver for wireless data communication interconnected with the antenna for electromagnetic field emission and electromagnetic field reception; wherein the antenna comprises: an electrically conductive material, and a slot in the electrically conductive material, the slot extending in a plane that is substantially parallel with a body of a user when the antenna system is worn in its operational position by the user, the slot being configured to cause emission of an electromagnetic field upon excitation.

Optionally, an electromagnetic field emitted by the antenna propagates along a surface of the body of the user with its electrical field substantially orthogonal to the surface of the body of the user.

Optionally, the antenna system is configured to enable communication between at least two wearable computing devices.

Optionally, the antenna system further includes a feed for exciting an electromagnetic field into the slot.

Optionally, the electrically conductive material with the slot forms a resonant structure.

Optionally, the electrically conductive material with the slot has a form of a rod, a monopole antenna, or a loop.

Optionally, the antenna system is on or parallel to a face plate of an in-the-ear hearing aid, is on or parallel to a side plate of a behind-the-ear hearing aid, or is on a substrate of a wearable computing device, the substrate being configured to be positioned parallel to the body of the user.

Optionally, the antenna system further includes a capacitor, the capacitor being positioned across the slot for tuning of a center frequency of the antenna.

Optionally, the antenna system is a part of a wearable computing device.

Other and further aspects and features will be evident from reading the following detailed description.

BRIEF DESCRIPTION OF THE DRAWINGS

The drawings illustrate the design and utility of various features described herein, in which similar elements are referred to by common reference numerals. These drawings are not necessarily drawn to scale. In order to better appreciate how the above-recited and other advantages and objects are obtained, a more particular description will be rendered, which are illustrated in the accompanying drawings. These drawings depict only exemplary features and are not therefore to be considered limiting in the scope of the claims.

DETAILED DESCRIPTION

Figures 1A, 1B:
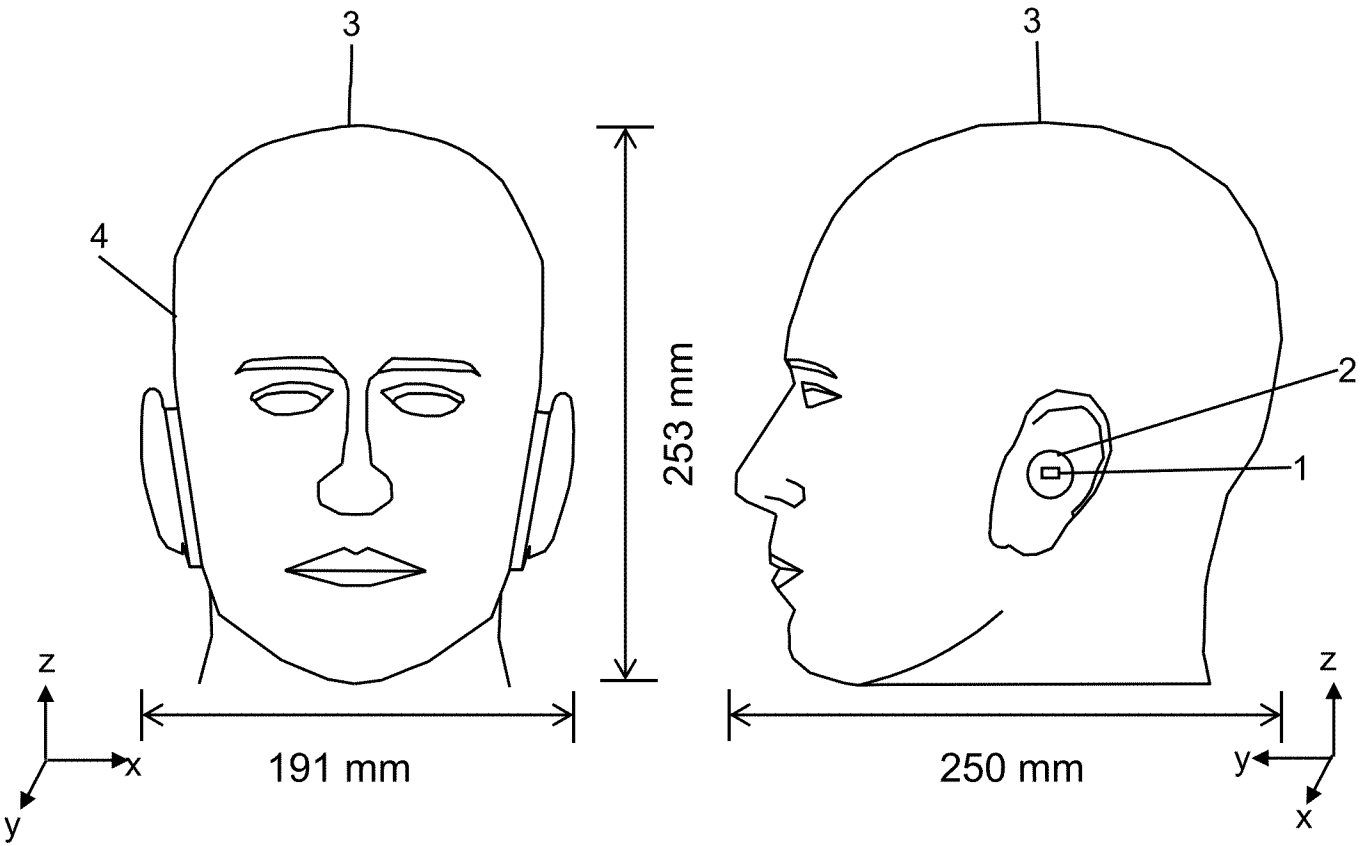
FIGS. 1*a* and 1*b* show a phantom head model of a user.

Various features are described hereinafter with reference to the figures. It should be noted that the figures are not drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated, or if not so explicitly described.

FIG. 1*a* is a phantom head model of a user seen from the front, and in FIG. 1*b* the phantom head model of the user is seen from the side together with the ordinary rectangular three dimensional coordinate system. In FIG. 1*b*, the face plate of an in-the-ear, ITE, hearing aid is seen, and the slot 2 forms an opening in the middle of the face plate.

When designing antennas for wireless communication proximate the human body, the human head can be approximated by a rounded enclosure with sensory organs, such as the nose, ears, mouth and eyes attached thereto. Such a rounded enclosure 3 is illustrated in FIGS. 1*a* and 1*b*. In FIG. 1*a*, the phantom head model is shown from the front together with an ordinary rectangular three dimensional coordinate system with an x, y and z axis for defining orientations with relation to the head and in FIG. 1*b*, the phantom head model is shown from one side together with an ordinary rectangular three dimensional coordinate system with an x, y and z axis for defining the geometrical anatomy of the head of the user;

Every point of the surface of the head has a normal and tangential vector. The normal vector is orthogonal to the surface of the head while the tangential vector is parallel to the surface of the head. An element extending along the surface of the head is said to be parallel to the surface of the head, likewise a plane extending along the surface of the is said to be parallel to the surface of the head, while an object or a plane extending from a point on the surface of the head and radially outward from the head into the surrounding space is said to be orthogonal to the head.

As an example, the point with reference numeral 4 in FIG. 1*a* furthest to the left on the surface of the head in FIG. 1*a* has tangential vectors parallel to the yz-plane of the coordinate system, and a normal vector parallel to the x-axis. Thus, the y-axis and z-axis are parallel to the surface of the head at the point 4 and the x-axis is orthogonal to the surface of the head at the point 4.

The user modelled with the phantom head of FIGS. 1*a* and 1*b* is standing erect on the ground (not shown in the figure), and the ground plane is parallel to xy-plane. The torso axis from top to toe of the user is thus parallel to the z-axis, whereas the nose of the user is pointing out of the paper along the y-axis.

The axis going through the right ear canal and the left ear canal is parallel to the x-axis in the figure. This ear to ear axis (ear axis) is thus orthogonal to the surface of the head at the points where it leaves the surface of the head. The ear to ear axis as well as the surface of the head will in the following be used as reference when describing specific configurations of the elements of one or more embodiments.

Since the auricle of the ear is primarily located in the plane parallel to the surface of the head on most test persons, it is often described that the ear to ear axis also functions as the normal to the ear. Even though there will be variations from person to person as to how the plane of the auricle is oriented.

The in the ear canal type of hearing aid will have an elongated housing shaped to fit in the ear canal. The longitudinal axis of this type of hearing aid is then parallel to the ear axis, whereas the face plate of the in the ear type of hearing aid will typically be in a plane orthogonal to the ear axis. The behind the ear type of hearing aid will typically also have an elongated housing most often shaped as a banana to rest on top of the auricle of the ear. The housing of this type of hearing aid will thus have a longitudinal axis parallel to the surface of the head of the user.

Figure 2:
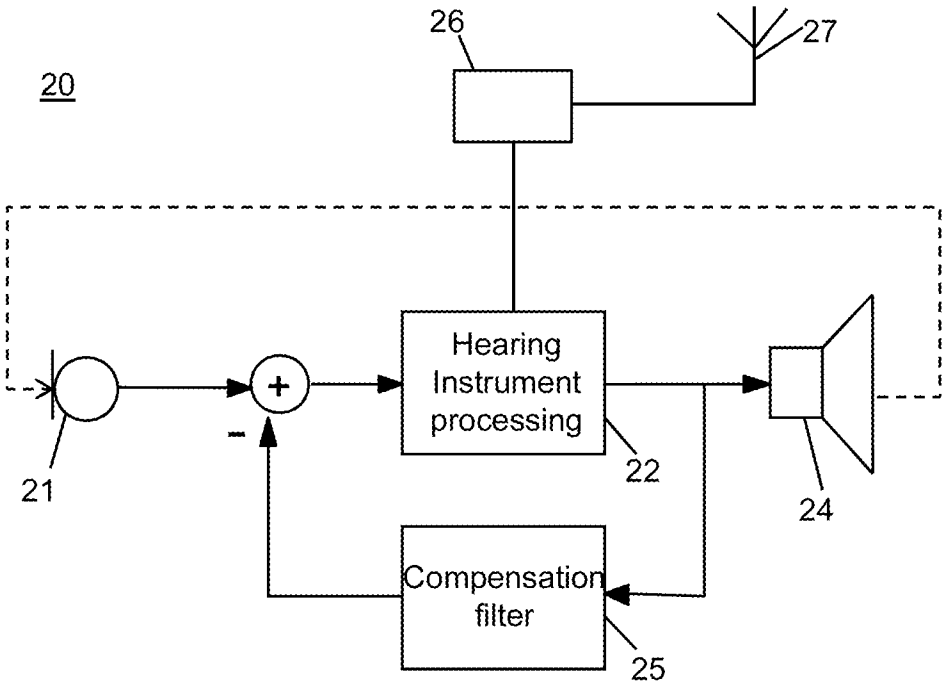
PRIOR ART FIG. 2
FIG. 2 shows a block-diagram of a typical (prior-art) hearing instrument.

A block-diagram of a typical (prior-art) hearing instrument is shown in FIG. 2. The hearing aid assembly 20 comprises a microphone 21 for receiving incoming sound and converting it into an audio signal, i.e. a first audio signal. The first audio signal is provided to a signal processor 22 for processing the first audio signal into a second audio signal compensating a hearing loss of a user of the hearing aid. A receiver 23 is connected to an output of the signal processor 22 for converting the second audio signal into an output sound signal, e.g. a signal modified to compensate for a users hearing impairment, and provides the output sound to a speaker 24. Thus, the hearing instrument signal processor 22 may comprise elements such as amplifiers, compressors and noise reduction systems etc. The hearing instrument or hearing aid may further have a feedback loop 25 for optimizing the output signal. The hearing aid may furthermore have a transceiver 26 for wireless data communication interconnected with an antenna 27 for emission and reception of an electromagnetic field. The transceiver 26 may connect to the hearing instrument processor 22 and an antenna, for communicating with external devices, or with another hearing aid, located at another ear, in a binaural hearing aid system.

Figure 3:
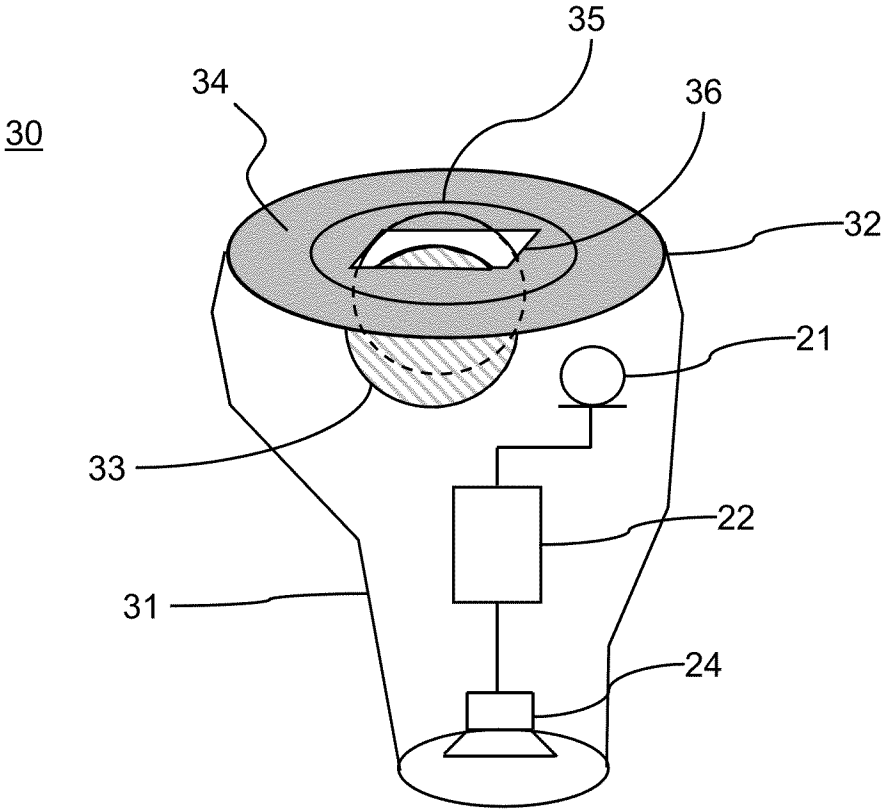
FIG. 3 shows schematically the position of the slot antenna in an in-the-ear hearing aid.

In FIG. 3, a hearing aid of the in the ear canal type, an ITE hearing aid 30 according to some embodiments is illustrated schematically, and FIG. 3 shows schematically the position of a slot antenna in an ITE hearing aid 30.

The housing 31 comprises a hearing aid assembly 20, illustrated with a microphone 21, a signal processor 22 and speaker 24. The housing 31 is typically molded to fit in the ear canal of a user, and a face plate 32 is provided on the outer end of the hearing aid. The housing 31 typically encompasses the face plate 32, however, for illustrative purposes, this part of the housing is not shown in FIG. 3. A hearing aid battery 33 is provided in the housing, to supply the hearing aid assembly with power.

An antenna 34, 35 is provided on the face plate 32, the antenna 34, 35 comprising a conductive material 34 having a slot 35 defined therein. Typically, the conductive material may be provided on a supporting element, such as a substrate. The conductive material 34 may be a print, such as a printed circuit board. The slot 35 is made by cutting away material and the slot 35 is typically void of conductive material 34. The slot 35 may form an opening in the conductive material 35. In the present example, the slot 35 forms a loop, and thus, the conductive material 34 with the loop slot 35 forms an antenna, such as a slot loop antenna 34, 35. In FIG. 3, it is seen that a further opening 36 is provided in the conductive material 34 to accommodate a battery 33. Thus, the loop slot may surround the opening 36. The opening should be so large so as to be able to receive a hearing aid battery. The battery 33 may protrude from the opening 36, or the battery 33 may be positioned behind the face plate 32 in the hearing aid housing 31.

It is seen that the slot 35 provided in the electrically conductive material 34 extends in a plane being substantially orthogonal with an ear to ear axis of the user when the hearing aid is worn in its operational position by a user. The slot 35 may be configured to cause emission of an electromagnetic field upon excitation. Preferably, the electromagnetic field emitted by the antenna propagates along the surface of the head of the user with its electrical field substantially orthogonal to the surface of the head of the user.

Figure 4:
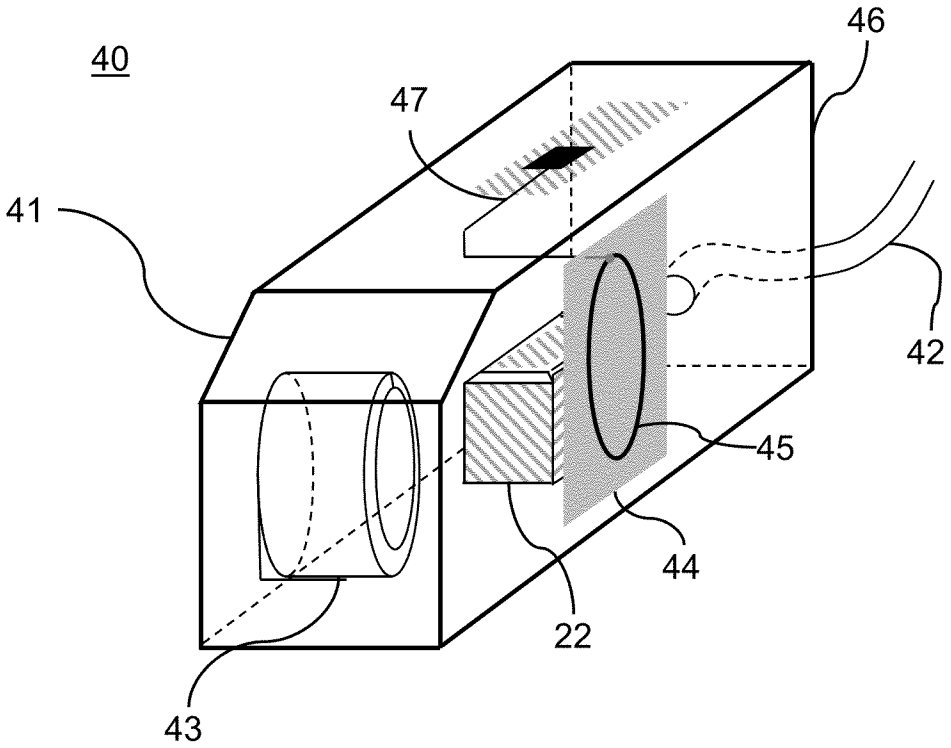
FIG. 4 shows schematically the position of the slot antenna on a BTE hearing aid.

FIG. 4 shows schematically a hearing aid 40 of the behind the ear type, a BTE hearing aid 40 and FIG. 4 shows schematically the position of the slot antenna on a BTE hearing aid 40. The hearing aid 40 is provided in a housing 41 to be provided behind the ear of a user. A sound tube 42 guides the sound from the hearing aid 40 to the ear canal (not shown in FIG. 4). An antenna 44, 45 is provided on one side 46 of the hearing aid 40. Preferably, the antenna 44, 45 is positioned on the side 46 of the hearing aid 40 which is configured to be furthest away from the head of a user when the hearing aid 40 is positioned in its operative position behind the ear of a user. The antenna 44, 45 comprises an electrically conductive material 44 having a slot 45 provided in the electrically conductive material 44, the electrically conductive material 44 and the slot 45 forming a slot antenna 44, 45. The slot antenna is fed by the feeding line 47.

As the size constraints in the hearing aids, and especially, in the ITE hearing aids are significant, it is an advantage that the antenna according to some embodiments may be a planar antenna which may be positioned on a part of the hearing aid forming a plane parallel to the surface of the head.

Typically, the electrically conductive material 34, 44 forms a ground plane for the antenna 34, 35, 44, 45. It is envisaged that for the electrically conductive material to form a ground plane for the antenna, the electrically conductive material may extend sufficiently on all sides of the slot. However, also for example a conductive layer on a back side of the face plate 32 or an inner side of the side 46 may form a ground plane for the antenna 34, 35, 44, 45.

Figure 5A:
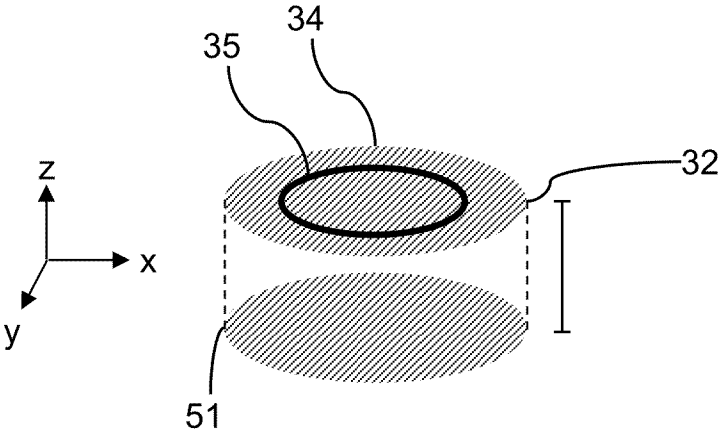
FIGS. 5*a* and 5*b* show a reflector plane and the position in an in-the-ear hearing aid.
Figure 5B:
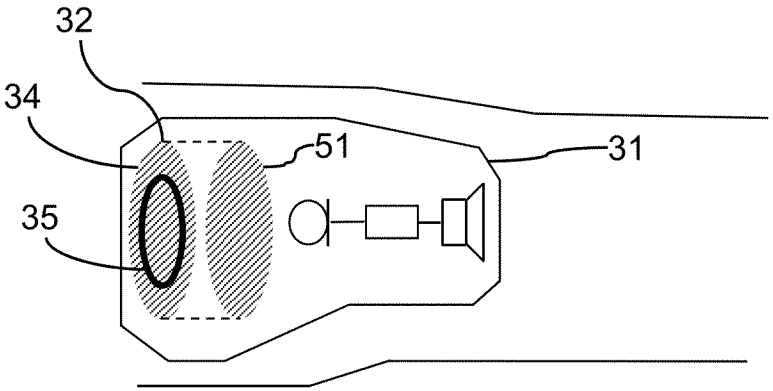

Furthermore, a reflector plane may be provided to increase the efficiency of the antenna 34, 35, 44, 45 and FIGS. 5*a* and 5*b* show a reflector plane 51 and the position in an ITE hearing aid. In a plane behind the face plate 32, that is, in a plane closer to the ear drum with respect to the antenna 34, 35, a reflector is provided, preferably in a plane parallel to, or substantially parallel to the face plate 32. In FIG. 5*b*, the position of the ITE hearing aid 30 in an ear canal 52 is shown.

Figure 6B:
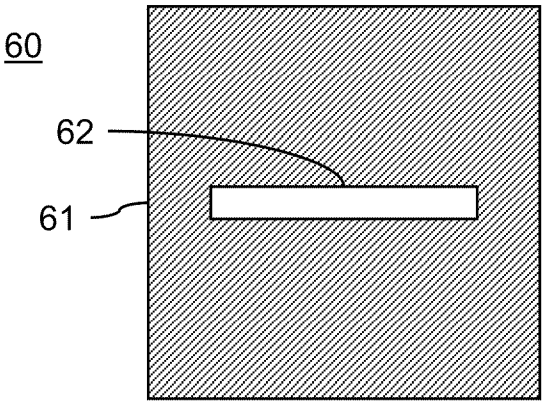
FIGS. 6*a-d* illustrates exemplary slot shapes.
Figure 6D:
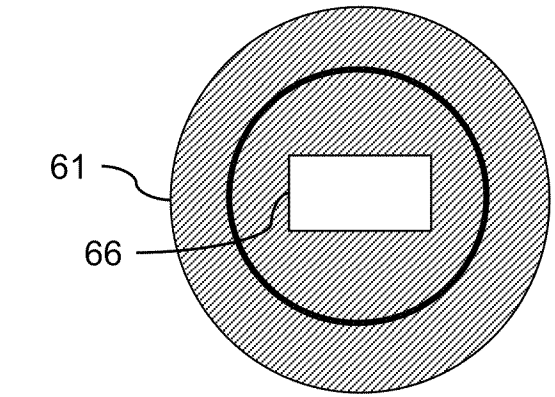
Figure 6A:
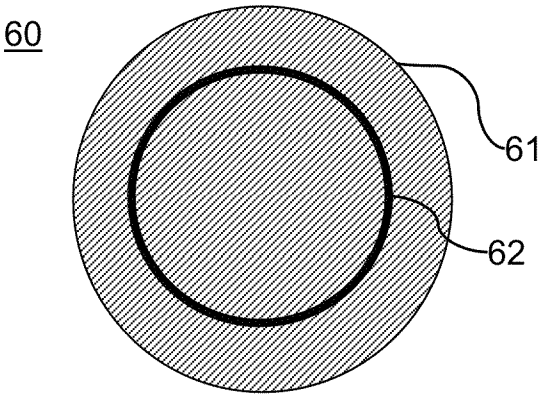
Figure 6C:
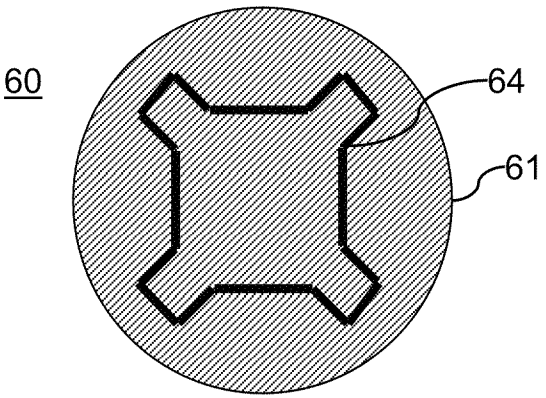

FIGS. 6*a-d* illustrates antennas 60 having exemplary slot shapes 62, 63, 64 provided in an electrically conductive material 61. The slot may have substantially any form, such as a loop formed slot 62, as seen in FIG. 6*a*, or the form of an elongated slot 63, as seen in FIG. 6*b*. Alternatively, to fit a slot having the length or e.g. a quarter wavelength or half a wavelength, the shape may a straight line, a twisted line, a coiled line, a fractal formed antenna, a folded antenna, etc., such as illustrated in FIG. 6*c*, wherein the loop slot has the form of a first order Sierpiensky curve 64. In FIG. 6*d*, an opening 66 for example for receiving a hearing aid battery is provided well within the loop formed slot 62.

Figure 7A:
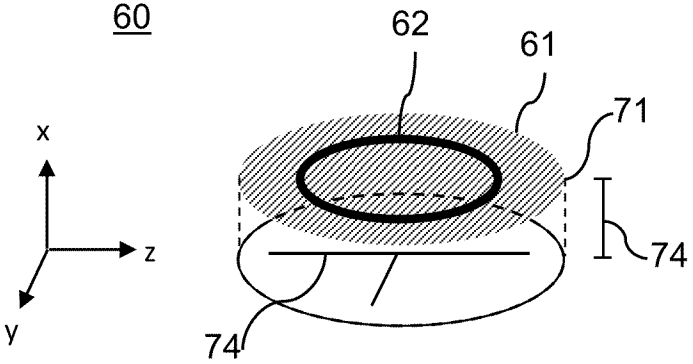
FIGS. 7*a-d* illustrates exemplary feeding for the antenna.

The antenna may be fed or excited in any known way, and FIGS. 7*a*-7*d* illustrates exemplary feeding points and feeding lines 71 for the antenna 60. In FIG. 7*a* a microstrip feed is illustrated in an elevated side view of the antenna and corresponding feed. The antenna 60 has an electrically conductive material 61 and a slot 62 provided in the electrically conductive material 61. The antenna 60 is an antenna, such as a planar antenna, provided in a plane 71 extending the yz-plane, that is substantially parallel to the surface of the head or the body of a user, cf. FIGS. 1*a* and 1*b*.

Figure 7B:
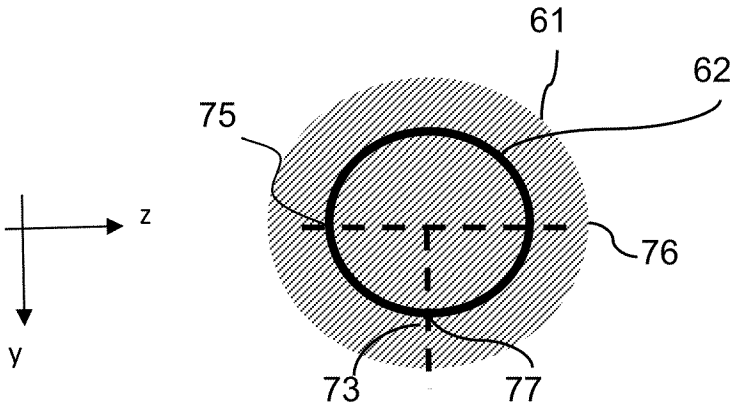

A T-shaped feed line 73 is provided below the slot 62 in a plane 72 provided parallel to, or substantially parallel to, the plane 71 of the slot. When a current is applied to the T-shaped feed line 73, an electromagnetic field may be introduced in the slot by coupling of the field from the feed line 73 to the slot 62. The distance 74 between the slot plane 71 and the feed plane 72 is thus configured to allow for an efficient coupling between the feed line and the slot. The feed line may be a microstrip feeding line. In FIG. 7*b*, a top view of the antenna 61, 62 is illustrated, with the feed line 73, dashed, shown to be below the antenna 61, 62. It is seen that the feed line extends across the loop, and thus across the slot 62 in a number of places 75, 76, 77.

Figure 7D:
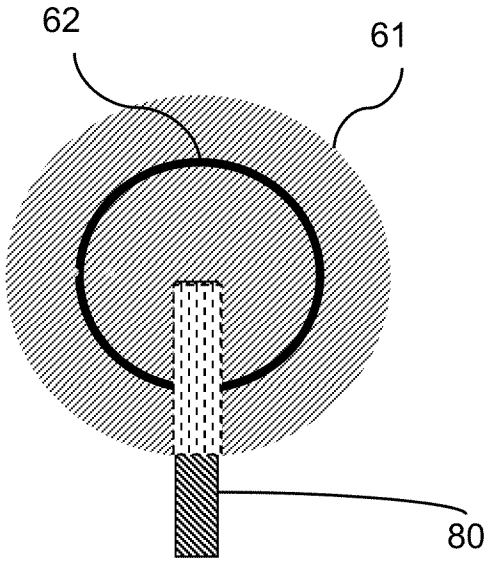
Figure 7C:
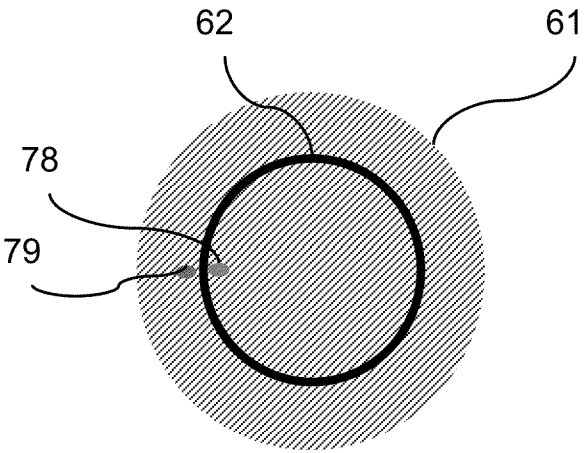

In FIG. 7*c*, a point feed is shown in which current is applied across the slot 61 from a ground connection 78 to a supply connection 79.

FIG. 7*d* shows a single microstrip feed line 80, provided in a plane 72 below the plane 71 of the slot 62, that is on the side of the antenna closest to the head or the body of a user. The single microstrip feed line 80 is shown as dashed when provided below the antenna 61, 62.

Typically, a the feed line is positioned in between the antenna 61, 62 and a reflector plane, if a reflector plane is present.

Figure 8B:
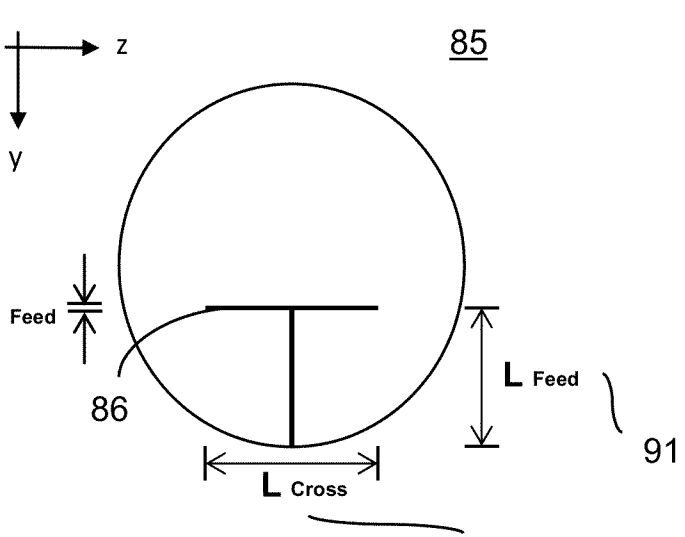
FIGS. 8*a-c* show a specific embodiment.
Figure 8A:
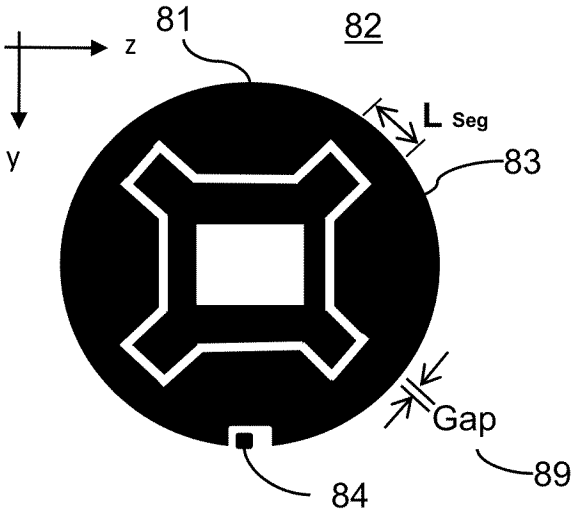
Figure 8C:
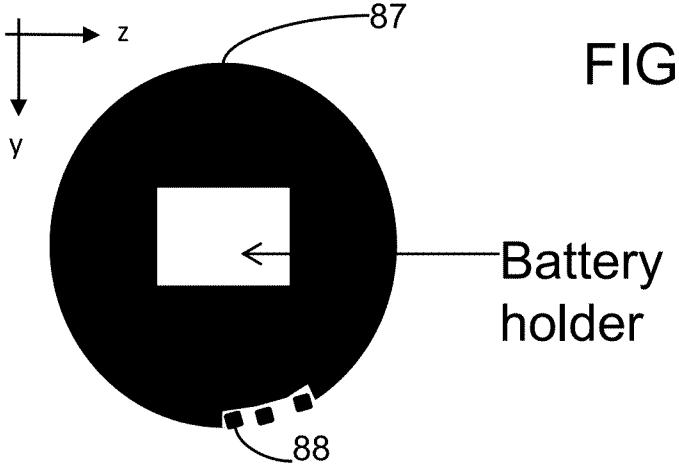

FIGS. 8*a-c* show a specific embodiment and the geometry of the slot antenna is illustrated. The design of the antenna is based on a slot loop antenna which provides a bi-directional radiation characteristic. In the present embodiment, the antenna is manufactured in a 3-layer print. In FIG. 8*a*, the top layer 82 is shown. The slot 83 is provided in the top layer and an outer or surface metal part 81 of the top layer print is used as the ground plane. The outer metal part being an electrically conductive material 82 is, thus, electrically conducting, and the top layer is provided with a solder island 84 for connecting the feed. FIG. 8*b* shows a middle layer 85 having a T-shaped strip line 86. FIG. 8*c* shows a bottom layer with reflector plane 87 and a solder island 88 for connecting to the feed 86 and the top ground plane 82. The bottom layer may be a copper plane. The copper plane adjusts the radiation so that the radiation pattern seemingly is more parallel to the head, than without the reflector. The top layer extends in the zy plane which is substantially parallel to the head. It is seen that the slot loop 83 is placed in a plane parallel to the head, that is, a plane perpendicular to the ear-to-ear axis of a user, when the hearing aid is positioned in its operative position.

In order to increase the length in a limited area, the shape of the slot is based on the 1st iteration of the Sierpiensky space filling curve. It is however envisaged that the antenna may be folded in a number of ways to maintain the overall length in a limited area.

The antenna is made on a Rogers TMM® 6 substrate 82, a thermo set ceramic loaded plastic with a layer thickness 0.381 mm and a relative permittivity r=6, using copper with a thickness 0.017 mm as the conducting material 81. The antenna 81, 83 is confined on a round plate, such as a face plate of a hearing with a diameter of 20 mm. The slot as provided has a total length of 64 mm with a segment length $L_{seg}$=4.0 mm and a slot width 89, $W_{seg}$=0.5 mm. In FIG. 7*b*, the feed 86 is seen and the feed line 86 has a width 90 of $W_{Feed}$=0.344 mm and length 91 of $L_{Feed}$=7.682 mm. The T-cross strips have the same width as the feed, and a length 92 of $L_{cross}$=9.406 mm. It is however envisaged that these measures are merely exemplary measures, and that the person skilled in the art will know to fold the slot in any conventional way to provide optimal power in the limited space available.

The antenna is designed for use in the face plate of a hearing aid, and a hole 93 is provided in the top layer 82 and in the bottom layer 87, within the slot loop 83. The size of the hole 93 is in the present embodiment 7.8 mm by 4.6 mm to fit the battery and associated springs fitting a standard hearing aid battery (IEC: PR70). However, other sizes may be envisaged as other hearing aids may use different battery sizes. In all the simulations the battery has been simulated as an aluminium box.

In the simulations of the antenna, the feed is directly matched to 50 Ohms.

Figure 9A:
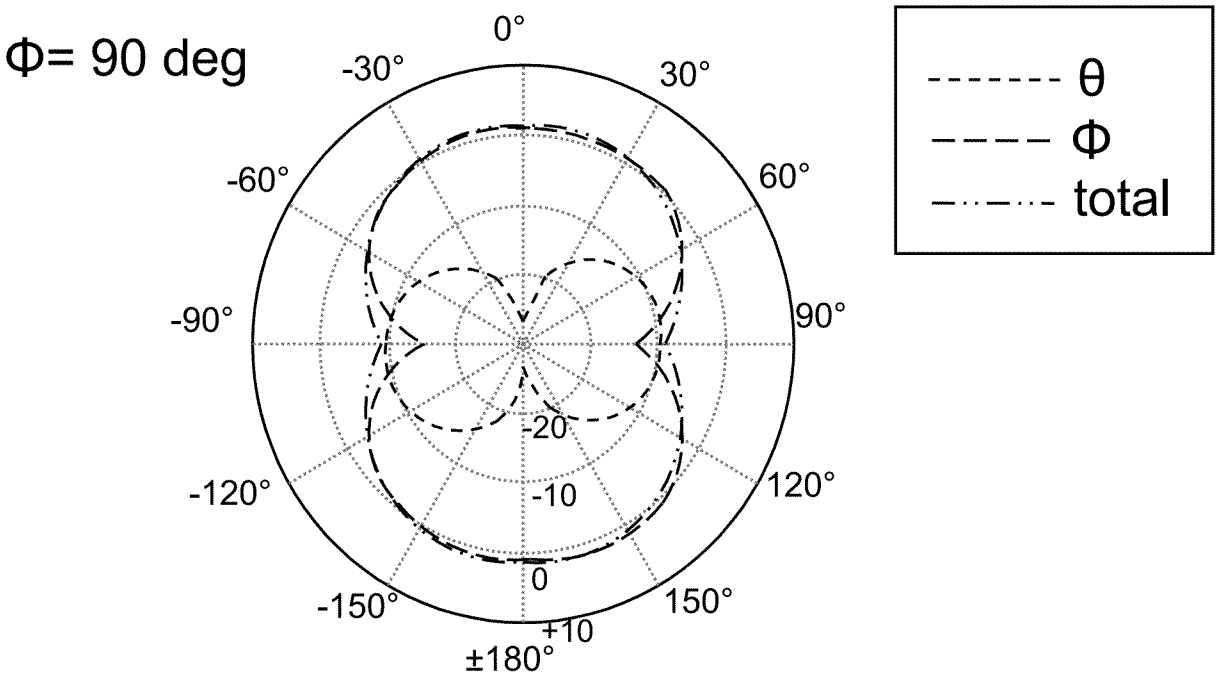
FIG. 9*a-c* show the free space radiation pattern for the antenna in FIGS. 8*a-c,*
Figure 9B:
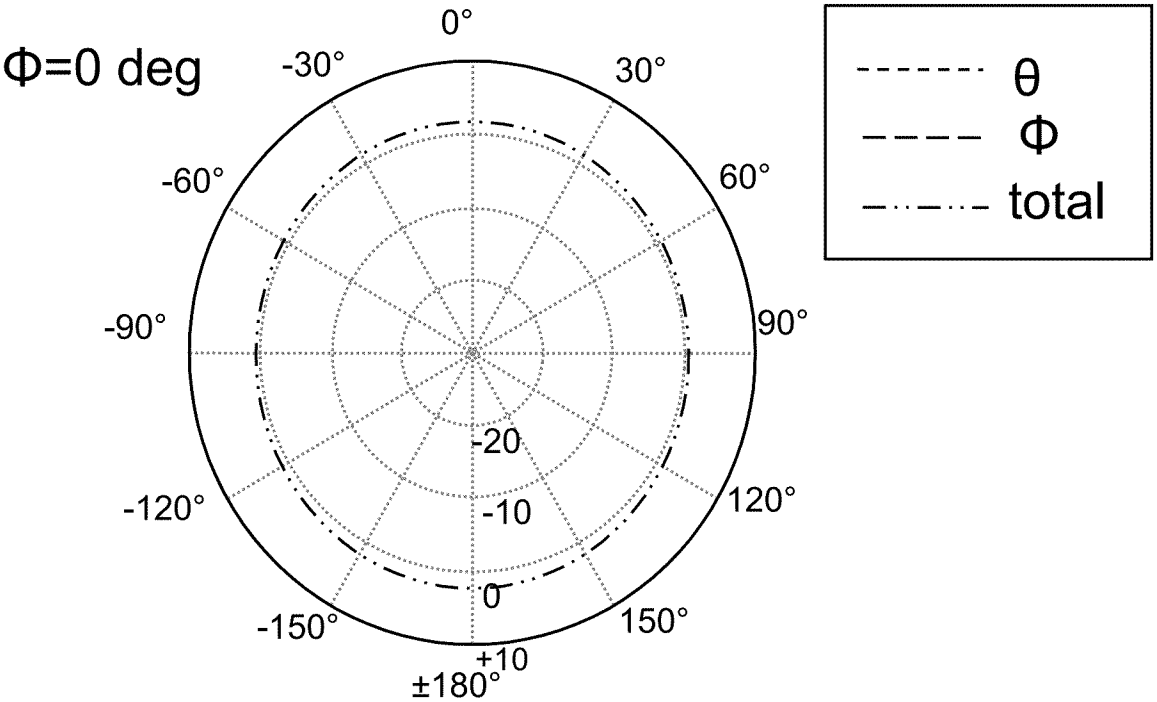
Figure 9C:
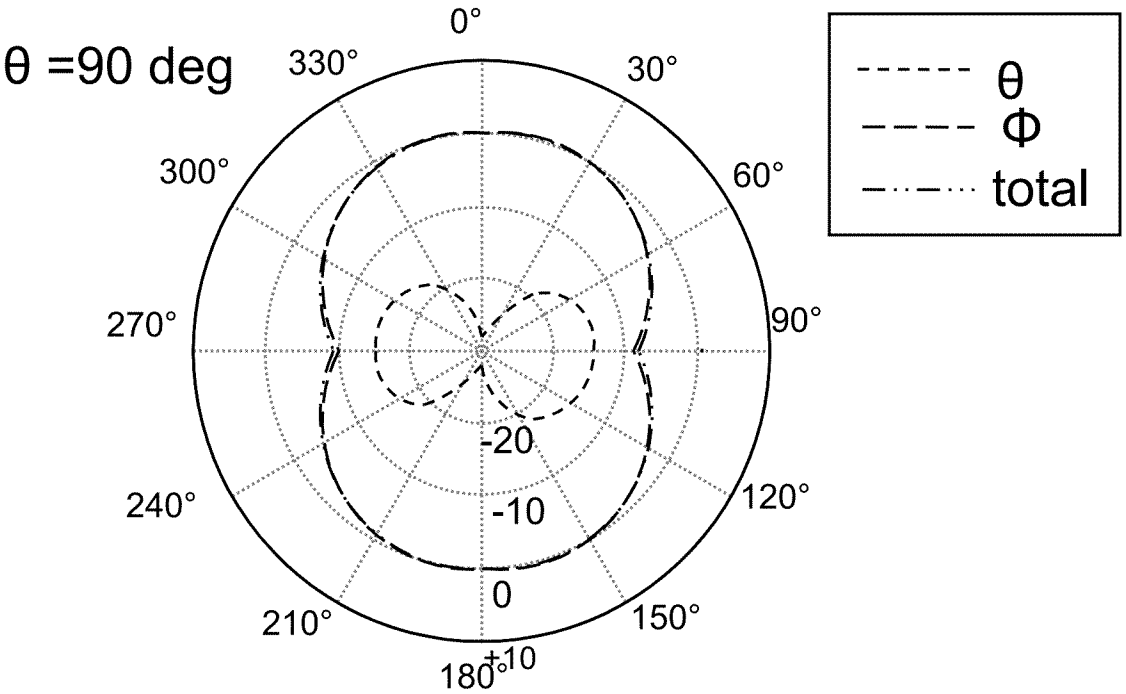

To optimize the ear-to-ear connection, the radiation pattern at 2.45 GHz is required to have maximized radiation along the surface of the head, as presented. The directivity pattern in free space at 2.45 GHz of the antenna as described in relation to FIGS. 8*a-c* is plotted in FIG. 9*a-c* wherein the θ and ϕ lines indicates the θ polarized radiation and the ϕ polarized radiation, respectively. FIG. 9*a* shows the radiation pattern in the xz-plane, FIG. 9*b* shows the radiation in the xy-plane, and FIG. 9*c* shows the radiation in the yz-plane. It is desired that the antenna radiates mainly in the zy-plane direction and has a minimum in the x direction, where the x-axis is corresponds to the ear-to-ear axis.

It is seen that the radiation pattern is non-omnidirectional and the influence of the head size may therefore be reduced. Furthermore, a capacitor is placed across the gap on the opposite side of the feed entry point. This may reduce the center frequency and in the present embodiment a capacitor value of 8.2 pF was found to provide a center frequency of 2.5 GHz when the antenna was placed in the ear. By changing the size of the capacitor after simulations with the phantom head 3 include a center frequency of approximately 2.5 GHz has been obtained despite the detuning by the head. The detuning by the head was found to decrease the center frequency by 0.05 GHz (2%).

In the present embodiment, a communication from e.g. one hearing aid in one ear of a user to another hearing aid in the other ear of the user is desired. In order to estimate ear-to-ear results, a phantom SAM head 3 as shown in FIG. 1 has been used. As the antenna is designed for use on a faceplate of an in-the-ear hearing aid. the antenna is placed right on top of the ear canal, in the yz-plane parallel to the head, as shown in FIG. 1. The ear canal is simulated as a cylinder with a radius of 6 mm and a depth of 20 mm. As the radiation pattern of the antenna in free space is non-uniform as seen in FIGS. 8*a-c*, the antenna has been positioned to have the best directivity pointing in the direction least affected by the ear.

Figure 10A:
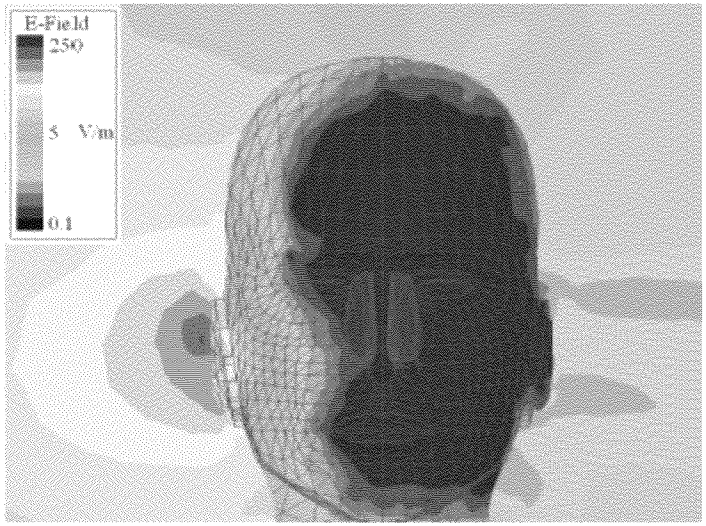
FIGS. 10*a-c* show the SAM simulated radiation pattern for the antenna in FIGS. 8*a-c,*
Figure 10B:
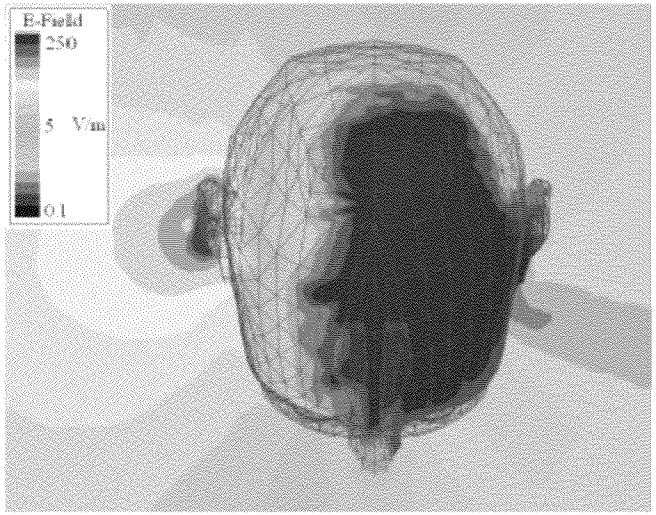
Figure 10C:
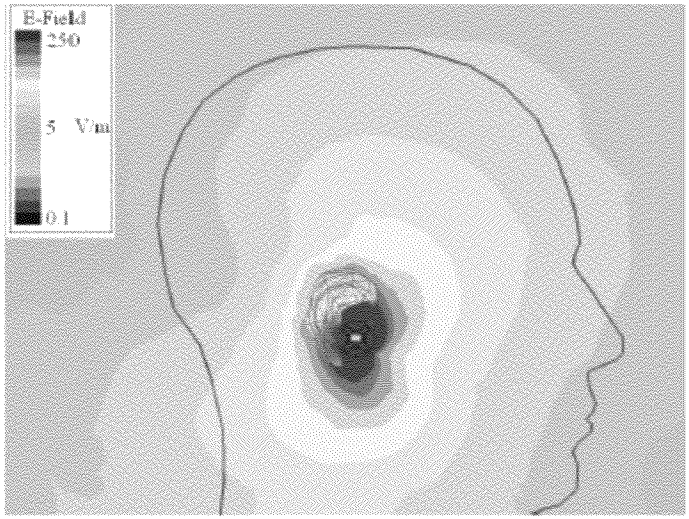

FIGS. 10*a-c* show the SAM simulated radiation pattern for the antenna in FIGS. 8*a-c*, FIG. 11 shows the simulated path gain of the antenna in FIGS. 8*a-c*.

The simulated radiation result of the antenna placed in the ear is displayed in FIGS. 10*a-c*, and plotted in the xz-, xy- and yz-plane, respectively. The radiation is the magnitude of the E-field at 2.45 GHz plotted on a logarithmic scale. The simulations are performed with only one radiating hearing aid antenna 61,62. The plots show the strength of the electric field around the head. The field strength in the plot is indicated by the tone of the grey-level: The stronger the field, the darker the grey level, however, also areas with no, or a very low field strength shows as dark grey or black. For example, the plot immediately around the radiating antenna positioned at a right ear of the head 3, is black. Thus, the field strength around the antenna is high. The grey-levels get paler and paler with increased distance to the antenna. The field strength at the receiving antenna at the opposite side of the head is very low and the plot around the receiving antenna is again almost black.

FIG. 10*a* shows the head from the front and the radiation in the xz-plane. It is seen that the field strength at the other ear is very low. FIG. 10*b* shows the head from the top and the radiation in the xy-plane, and in this plane, it is seen that the lighter areas, i.e. the areas with a higher field strength, extends to the second ear of the head 3. FIG. 10*c* shows the head from the side, and it is seen that the strength of the field is highest close to the ear. The plots show that the power is radiated along the head.

Figure 11:
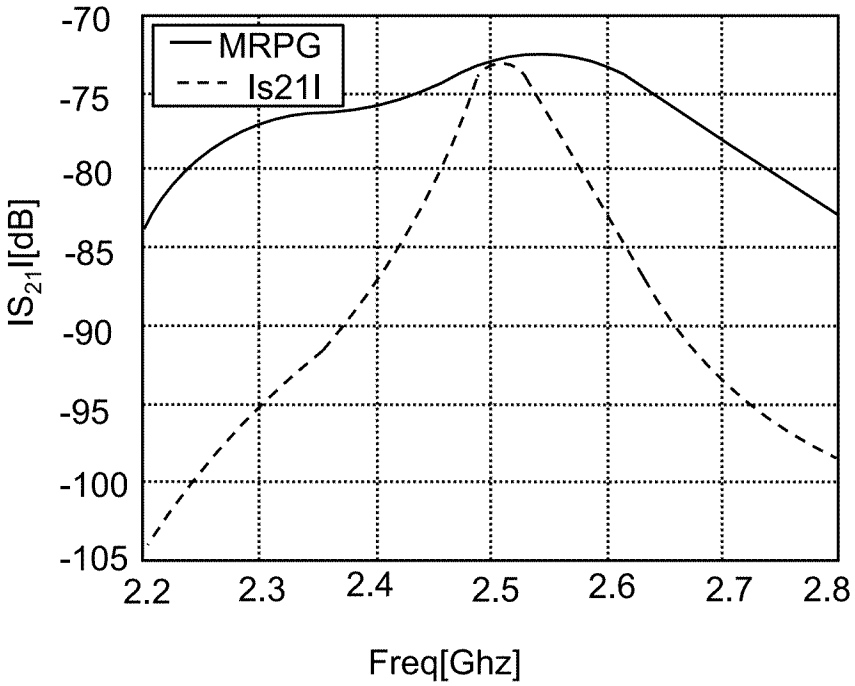
FIG. 11 shows the simulated path gain of the antenna in FIGS. 8*a-c*.
Figure 12:
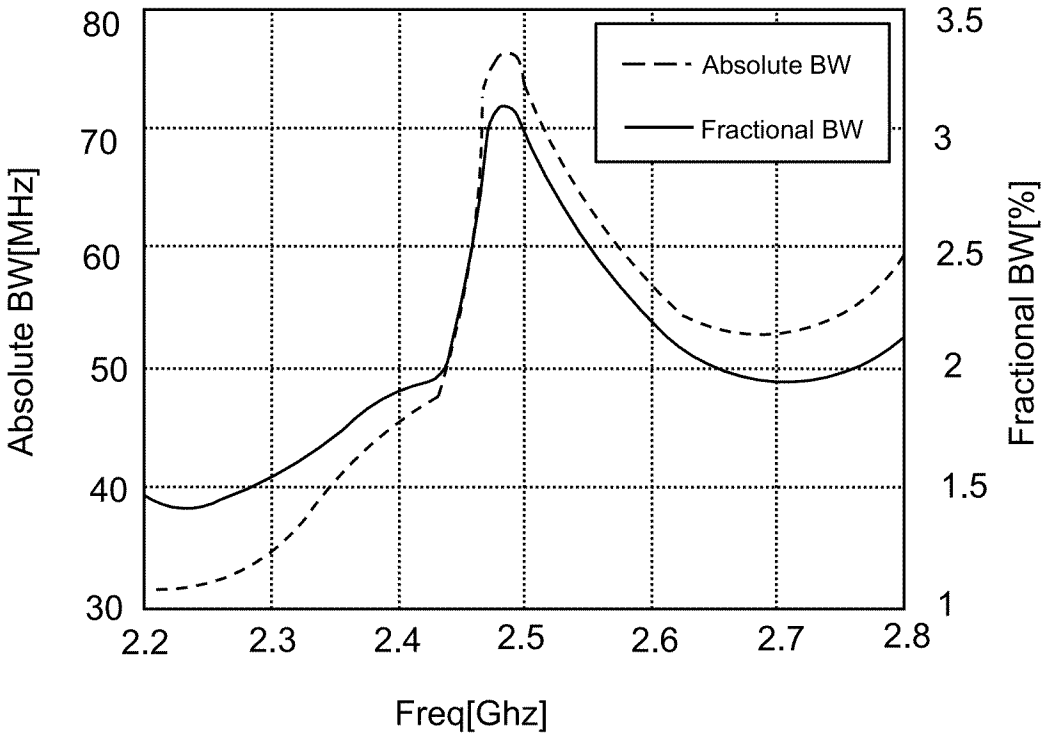
FIG. 12 shows the simulated bandwidth of the antenna in FIGS. 8*a-c*.

The total performance of the antenna may be judged by the ear-to-ear path gain, which is achieved as the magnitude of the [S21] parameter. The path gain is shown in FIG. 11. In Table I the antenna parameters are shown for the antenna as shown in FIG. 7. Typically, the limit for the transceiver is about −85 dB so that the transceiver will be able to detect the signals emitted from the first ear to the second ear.

TABLE 1

| |
|---|
| Center frequency, $f_c$ 2:50 GHz |
| Bandwidth, $BW_{3\ dB}$ B5:3% |
| $BW_{6\ dB}$ 3:1% |
| Radiation efficiency 5:3% |
| Path gain, [S21] Peak −73:3 dB |
| [S21] @ 2.45 GHz −80:4 dB |

The maximally realisable path gain (MRPG) at 2.45 GHz may be found to be −75.0 dB as seen from FIG. 11. An absolute bandwidth, $BW_{6dB}$ may be estimated to be 76.4 MHz (3.1%) and may be obtained at 2.50 GHz. At 2.45 GHz, a maximum $BW_{6dB}$ may be found to be 54.2 MHz (2.2%).

In a further embodiment of a medical device, such as for example a biosensor or a device for measuring glucose content is provided, the medical device comprising an antenna system as herein described. The device may be provided on a surface of a user body, and may communicate wirelessly with a reception device, such as a reception device in the form of a wrist watch, for outputting medical device measurements, such as glucose values to a user.

One or more embodiments described herein may be characterised by the following items:

1. An antenna system for a wireless body area network, the antenna system comprising a transceiver for wireless data communication interconnected with an antenna for emission and reception of an electromagnetic field wherein the antenna comprises an electrically conductive material, and a slot provided in the electrically conductive material and extending in a plane being substantially parallel with a user body when the antenna system is worn in its operational position by a user, the slot being configured to cause emission of an electromagnetic field upon excitation.

2. An antenna system according to item 1, wherein an electromagnetic field emitted by the antenna propagates along the surface of the head of the user with its electrical field substantially orthogonal to the surface of the head of the user.

3. An antenna system according to item 1 or 2, wherein the overall length of the slot relative to a circumference of the face plate is less than a threshold value.

4. An antenna system according to item 3, wherein the threshold value is 1.

5. An antenna system according to any of the previous items, wherein the antenna is a slot antenna 6. An antenna system according to any of the previous items, further comprising a feed for exciting an electromagnetic field into the slot.

7. An antenna system according to any of the previous items, wherein the slot is void of conductive material.

8. An antenna system according to any of the previous items, further comprising a feed line for the slot.

9. An antenna system according to item 8, wherein the feed line for the slot extends across a width of the slot.

10. An antenna system according to any of the previous items, wherein the slot forms a resonant structure.

11. An antenna system according to any of the previous items, wherein the slot has a length of ½ wavelength, ¼ wavelength or any multiple thereof.

12. An antenna system according to any of the previous items, wherein the slot has the form of a rod or monopole antenna.

13. An antenna system according to any of items 1-11, wherein the slot has the form of loop.

14. An antenna system according to any of the previous items, wherein the electrically conductive material is provided on or parallel to a face plate of an in-the-ear hearing aid.

15. An antenna system according to any of items 1-13, wherein the electrically conductive material is provided on or parallel to a side plate of a behind-the-ear hearing aid.

16. An antenna system according to any of the previous items, wherein the slot has a surface area that is less than a surface area of the electrically conducting material.

17. An antenna system according to any of the previous items, wherein a width of the slot is tailored according to an antenna impedance.

18. An antenna system according to any of the previous items, further comprising a reflector plane for the antenna.

19. An antenna system according to any of the previous items, wherein an opening is provided in the electrically conductive material, the opening being configured to receive a device battery.

20. An antenna system according to any of the previous items, wherein the electrically conductive material is provided on a first layer, and wherein a feed line is provided on a second layer, the second layer being parallel to the first layer.

21. An antenna system according to item 20, further comprising a third layer configured to form a reflector plane for the antenna.

22. An antenna system according to item 20 or 21, wherein an opening is provided in the first layer and/or the third layer for receiving a device battery.

23. An antenna system according to item 22, wherein the slot is a loop formed slot provided in the electrically conductive surface, and wherein the opening is provided within the loop formed slot.

24. An antenna system according to item 23, further comprising a door having an electrically conductive surface, the door being configured to close the battery opening, wherein a gap formed between the door and the electrically conductive material is configured to form the loop formed slot.

25. An antenna system according to any of the previous items, further comprising a capacitor, the capacitor being positioned across the slot for tuning of the center frequency of the antenna.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. An antenna system comprising:

an antenna; and a transceiver for wireless data communication interconnected with the antenna for electromagnetic field emission and electromagnetic field reception;

wherein the antenna comprises:

an electrically conductive material, and a slot in the electrically conductive material, the slot extending in a plane that is substantially parallel with a body of a user when the antenna system is worn in its operational position by the user, the slot being configured to cause emission of an electromagnetic field upon excitation; and wherein the antenna is sized for placement in an ear of the user.

2. The antenna system according to claim 1, wherein the electromagnetic field emitted by the antenna propagates along a surface of the body of the user with its electrical field substantially orthogonal to the surface of the body of the user.

3. The antenna system according to claim 1, wherein the antenna system is configured to enable communication between at least two wearable computing devices.

4. The antenna system according to claim 1, further comprising a feed for exciting an electromagnetic field into the slot.

5. The antenna system according to claim 1, wherein the electrically conductive material with the slot forms a resonant structure.

6. The antenna system according to claim 1, wherein the electrically conductive material with the slot has a form of a rod, a monopole antenna, or a loop.

7. The antenna system according to claim 1, wherein the antenna system is on or parallel to a face plate of an in-the-ear hearing aid, is on or parallel to a side plate of a behind-the-ear hearing aid, or is on a substrate of a wearable computing device, the substrate being configured to be positioned parallel to the body of the user.

8. The antenna system according to claim 1, further comprising a capacitor, the capacitor being positioned across the slot for tuning of a center frequency of the antenna.

9. A wearable computing device comprising the antenna system according to claim 1.

10. The antenna system according to claim 1, wherein the antenna is a part of a device that includes a faceplate, and wherein a total length of the slot measured along the slot is less than a length of a perimeter of the faceplate.

11. The antenna system according to claim 1, wherein the antenna is a part of a hearing aid configured to compensate for a hearing loss of the user.

12. The antenna system according to claim 1, wherein the antenna is sized for placement in an ear canal of the user.

13. The antenna system according to claim 1, wherein the antenna is sized for placement in a cavum conchae of the ear of the user.

* * * * *